US010443858B2

(12) United States Patent
Stokes et al.

(10) Patent No.: US 10,443,858 B2
(45) Date of Patent: Oct. 15, 2019

(54) COOKING APPLIANCE

(71) Applicant: Haier US Appliance Solutions, Inc., Wilmington, DE (US)

(72) Inventors: Andrea Nichole Stokes, Louisville, KY (US); John Adam Yantis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 80 days.

(21) Appl. No.: 15/414,671

(22) Filed: Jan. 25, 2017

(65) Prior Publication Data

US 2018/0209660 A1 Jul. 26, 2018

(51) Int. Cl.
*F24C 15/14* (2006.01)
*F24C 3/00* (2006.01)

(52) U.S. Cl.
CPC ..... *F24C 15/14* (2013.01); *F24C 3/008* (2013.01)

(58) Field of Classification Search
CPC .. F24C 15/14; F24C 3/02; F24C 3/002; F24C 3/082
USPC ..... 126/214 D
See application file for complete search history.

(56) References Cited

U.S. PATENT DOCUMENTS

| | | | | |
|---|---|---|---|---|
| 2,743,719 | A * | 5/1956 | Reeves | F24C 15/001 126/21 R |
| 7,533,666 | B2 | 5/2009 | Hosoi et al. | |
| 7,640,930 | B2 | 1/2010 | Little et al. | |
| 8,269,148 | B2 | 9/2012 | Marchand | |
| 2006/0144388 | A1* | 7/2006 | Hosoi | F24C 15/101 126/214 A |
| 2010/0108660 | A1* | 5/2010 | Yi | F24C 15/101 219/443.1 |
| 2015/0260416 | A1* | 9/2015 | Chadwick | F24C 15/006 454/56 |
| 2018/0003389 | A1* | 1/2018 | Trice | F24C 15/32 |

FOREIGN PATENT DOCUMENTS

WO WO2010131799 A1 11/2010

* cited by examiner

*Primary Examiner* — Steven B McAllister
*Assistant Examiner* — Allen R Schult
(74) *Attorney, Agent, or Firm* — Dority & Manning, P.A.

(57) ABSTRACT

A cooking appliance is generally provided herein. The cooking appliance may include a cabinet, a top panel, a burner, and a deflection plate. The cabinet may extend in a vertical direction from a top portion to a bottom portion. The cabinet may define a non-heated chamber between the top portion and the bottom portion. The top panel may be positioned at the top portion of the cabinet. The burner may be positioned on the top panel. The deflection plate may extend at a non-orthogonal angle from the top panel at a rear portion of the cabinet. The deflection plate may define a ventilation aperture above the non-heated chamber in fluid communication therewith.

18 Claims, 9 Drawing Sheets

COOKING APPLIANCE

FIELD OF THE INVENTION

The present subject matter relates generally to cooking appliances, and more particularly to cooking appliances having one or more features for managing spilled liquids or food items.

BACKGROUND OF THE INVENTION

Cooking appliances, such as cooktops or range appliances, generally include a burner or heat source positioned on a portion of a cabinet or support panel. Cooking appliance can include a variety of configurations for the heating sources located on a top surface. The number of heating sources or positions available for heating on the cook top can include e.g., four, six, or more depending upon the intended application and preferences of the buyer. These heating sources can vary in size and location along the surface of the cooking appliance.

Regardless of the heating source configuration, managing spills can be a common concern. For instance, when liquids within a utensil (e.g., pot) boil over and out of the utensil, the liquids may spill in an undesirable manner. It is possible for the liquids to spill, not only onto the top surface of the cooking appliance, but off of the top surface and onto the floor, wall, or side surface of the cooking appliance. Once the liquids have spilled off of the top surface of the appliance, they can become exceedingly difficult to clean. Moreover, in some appliances, spills risk significantly damaging other portions of the appliance. As an example, some appliances include one or more electronic components that are mounted on or adjacent to the side of an appliance cabinet. If liquids or foods spill out of a utensil and off of the top surface, it is possible that the spilled liquids or food might fall onto or inside the electronic components. The spilled items may become trapped and cause damage to the electronic components.

As a result, it would be advantageous to provide a cooking appliance that includes one or more features for managing spills. Moreover, it would be advantageous to provide a cooking appliance capable of controlling spills and containing spilled items within an area that is easy to clean and contained away from significant electronic components.

BRIEF DESCRIPTION OF THE INVENTION

Aspects and advantages of the invention will be set forth in part in the following description, or may be obvious from the description, or may be learned through practice of the invention.

In one aspect of the present disclosure, a cooking appliance is provided. The cooking appliance may include a cabinet, a top panel, a burner, and a deflection plate. The cabinet may extend in a vertical direction from a top portion to a bottom portion. The cabinet may define a non-heated chamber between the top portion and the bottom portion. The top panel may be positioned at the top portion of the cabinet. The burner may be positioned on the top panel. The deflection plate may extend at a non-orthogonal angle from the top panel at a rear portion of the cabinet. The deflection plate may define a ventilation aperture above the non-heated chamber in fluid communication therewith.

In another aspect of the present disclosure, a cooking appliance is provided. The cooking appliance may include a cabinet, a top panel, a burner, a shielding trim, and a deflection plate. The cabinet may extend in a vertical direction from a top portion to a bottom portion. The cabinet may define a non-heated chamber between the top portion and the bottom portion. The top panel may be positioned at the top portion of the cabinet. The burner may be positioned on the top panel. The shielding trim may extend along a perimeter segment of the cabinet. The shielding trim may define a spill opening to receive a liquid above the top panel. The deflection plate may be housed within the shielding trim. The deflection plate may extend at a non-orthogonal angle relative to a transverse direction. The deflection plate may define a ventilation aperture above the non-heated chamber in fluid communication therewith.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
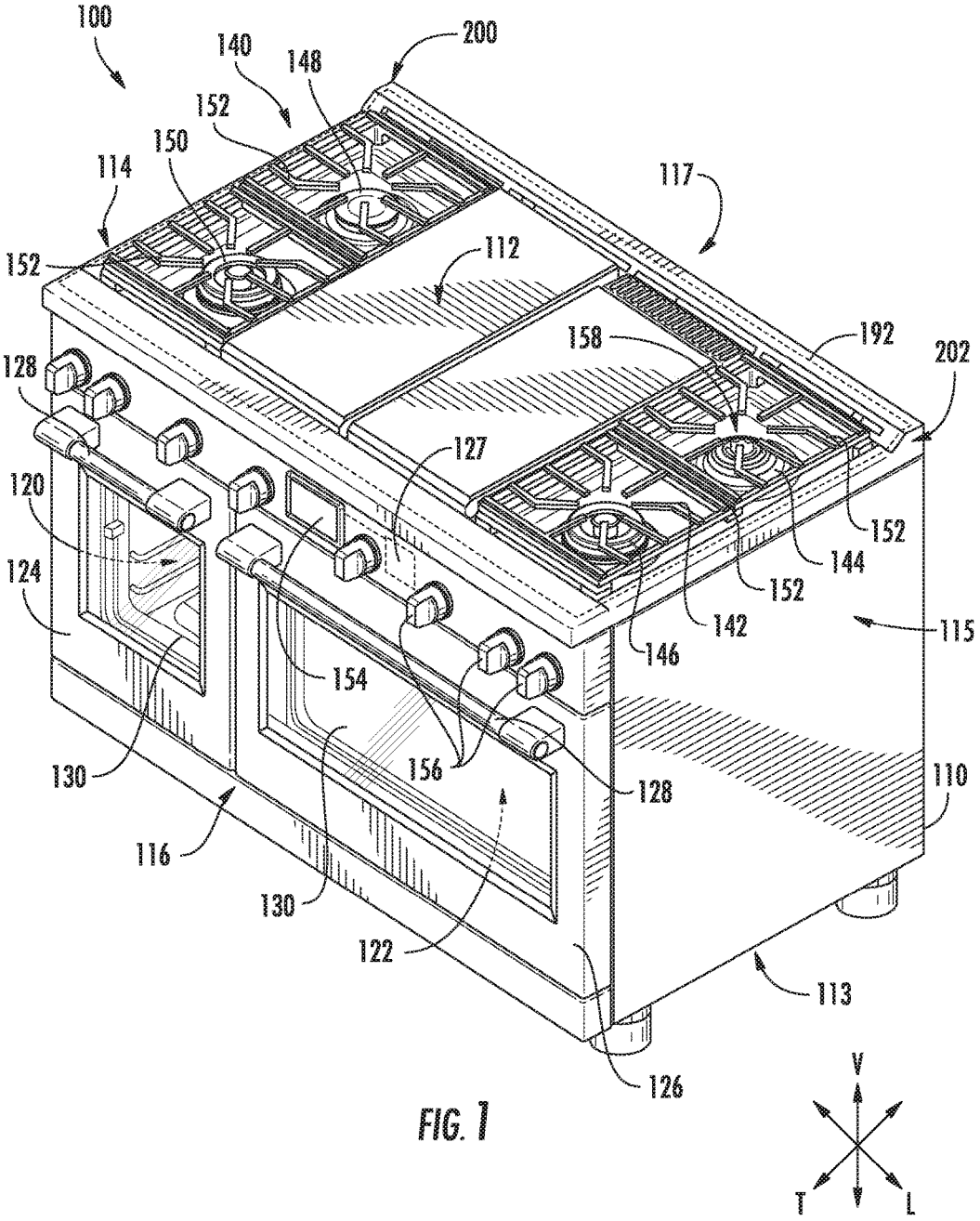
FIG. 1 provides a front perspective view of a cooking appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure may provide a cooking appliance that has one or more burners that are positioned on a top panel of the cooking appliance. The top panel may define a recessed area or well that can contain foods or liquids spilled from a utensil on or above one of the burners. A deflector assembly that includes a shielding trim and a deflection plate may be mounted along the back edge of the top panel. The deflector plate may cover a chamber or cavity, such as a chamber that encloses one or more electronic components at a back portion of the cooking appliance. In turn, liquids or food items that spill above the top panel may be deflected away from the electronics cavity and back towards the well around the burner(s).

Figure 2:
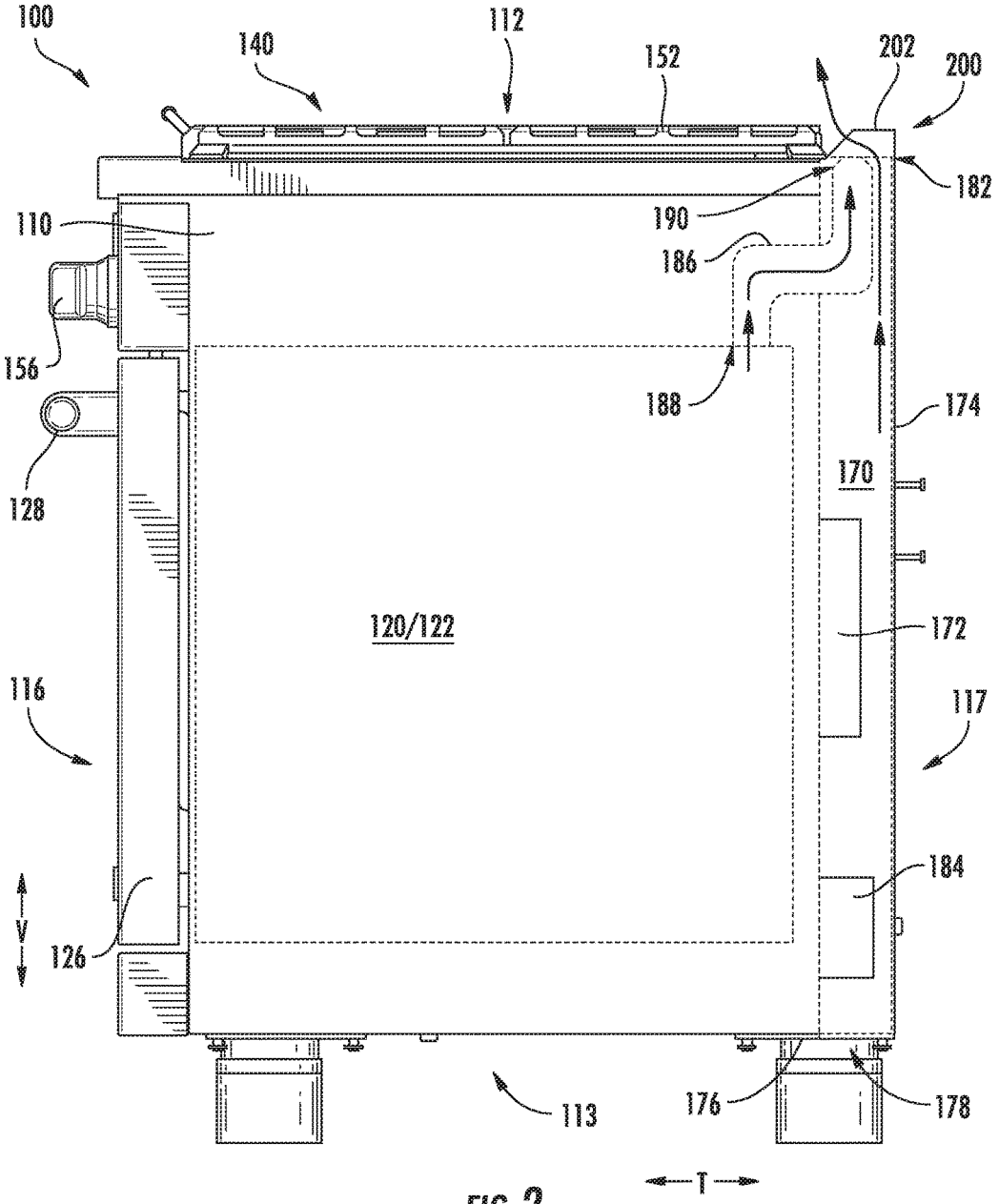
FIG. 2 provides a side view of the example cooking appliance of FIG. 1.

FIG. 1 provides a front, perspective view of a cooking appliance 100 as may be employed with the present disclosure. FIG. 2 provides a side view of cooking appliance 100. Cooking appliance 100 includes an insulated cabinet 110. As shown cooking appliance 100 defines a vertical direction V, a lateral direction L, and a transverse direction T, e.g., at cabinet 110. The vertical, lateral and transverse directions are mutually perpendicular and form an orthogonal direction system.

As shown, cabinet 110 extends along the vertical direction V between a top portion 112 and a bottom portion 113; along the lateral direction L between a left side portion 114 and a right side portion 115; and along the traverse direction T between a front portion 116 and a rear portion 117. Moreover, cabinet 110 defines a left cooking chamber 120 and a right cooking chamber 122. Thus, cooking appliance 100 is generally referred to as a double oven range appliance. As will be understood by those skilled in the art, cooking appliance 100 is provided by way of example only, and the present subject matter may be used in any suitable appliance, e.g., a single oven range appliance or a standalone cooktop appliance. Thus, the example embodiments illustrated in FIGS. 1 and 2 are not intended to limit the present subject matter to any particular cooking chamber configuration or arrangement, except as otherwise indicated.

Left and right cooking chambers 120 and 122 are configured for the receipt of one or more food items to be cooked. Cooking appliance 100 includes a left door 124 and a right door 126 rotatably attached to cabinet 110 in order to permit selective access to left cooking chamber 120 and right cooking chamber 122, respectively. Handles 128 are mounted to left and right doors 124 and 126 to assist a user with opening and closing doors 124 and 126 in order to access cooking chambers 120 and 122. As an example, a user can pull on handle 128 mounted to left door 124 to open or close left door 124 and access left cooking chamber 120. Glass window panes 130 provide for viewing the contents of left and right cooking chambers 120 and 122 when doors 124 and 126 are closed and also assist with insulating the cooking chambers 120 and 122. Heating elements (not shown), such as electric resistance heating elements, gas burners, microwave heating elements, halogen heating elements, or suitable combinations thereof, are positioned within left cooking chamber 120 and right cooking chamber 122 for heating left cooking chamber 120 and right cooking chamber 122.

Cooking appliance 100 also includes a cooktop 140. Cooktop 140 is positioned at or adjacent a top portion of cabinet 110. Thus, cooktop 140 is positioned above left and right cooking chambers 120 and 122. Cooktop 140 includes a top panel 142. By way of example, top panel 142 may be constructed of glass, ceramics, enameled steel, and combinations thereof.

For cooking appliance 100, a utensil (not pictured) holding food and/or cooking liquids (e.g., oil, water, etc.) may be placed onto cooking grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (e.g., pots, pans, etc.) of various sizes and configurations and to provide different heat inputs for such cooking utensils. Grates 152 are supported on a top surface 158 of top panel 142 and extend over at least one of burner assemblies 144, 146, 148, 150.

Cooking appliance 100 is further equipped with a controller 127 to regulate operation of the cooking appliance 100. For example, controller 127 may regulate the operation of cooking appliance 100 including burner assemblies 144, 146, 148, 150. Controller 127 may be in communication (via for example a suitable wired or wireless connection) with the burner assemblies 144, 146, 148, 150 and other suitable components of the cooking appliance 100, as discussed herein. In general, controller 127 may be operable to configure the cooking appliance 100 (and various components thereof) for cooking. Such configuration may be based on a plurality of cooking factors of a selected operating cycles, sensor feedback, etc.

By way of example, controller 127 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 127 may be positioned in a variety of locations throughout cooking appliance 100. As an example, one or more portions of controller 127 may be located within a user interface panel 154 of cooking appliance 100. In such an embodiment, input/output ("I/O") signals may be routed between the control system and various operational components of cooking appliance 100 along wiring harnesses that may be routed through cabinet 110. Typically, controller 127 is in communication with user interface panel 154 through which a user may select various operational features and modes and monitor progress of cooking appliance 100. In example embodiments, user interface panel 154 may represent a general purpose I/O ("GPIO") device or functional block.

In some embodiments, user interface panel 154 is located within convenient reach of a user of the cooking appliance 100. For some example embodiments, user interface panel 154 includes knobs 156 that are each associated with one of burner assemblies 144, 146, 148, 150. Knobs 156 allow the user to activate each burner assembly and determine the amount of heat input provided by each burner assembly 144, 146, 148, 150 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of cooking appliance 100 shown in FIG. 1 is provided by way of example only. More specifically, user interface panel 154 may include various input components, such as one or more of a variety of touch-type controls, electrical, mechanical or electromechanical input devices including rotary dials, push buttons, and touch pads. The user interface panel 154 may include other display components, such as a digital or analog display device designed to provide operational feedback to a user.

Figure 3:
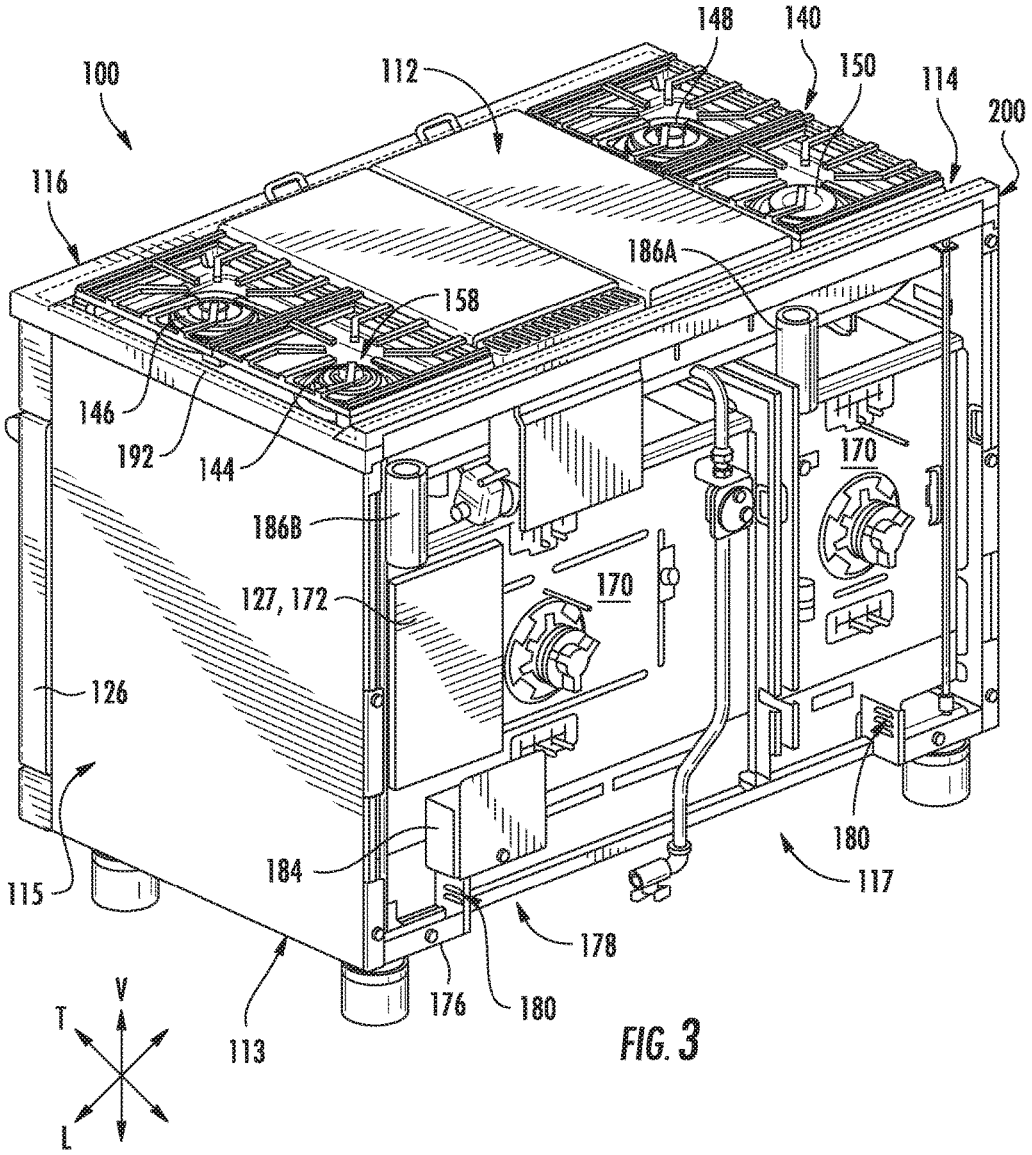
FIG. 3 provides a rear perspective view of the example cooking appliance of FIG. 1, wherein a back panel has been removed.
Figure 4:
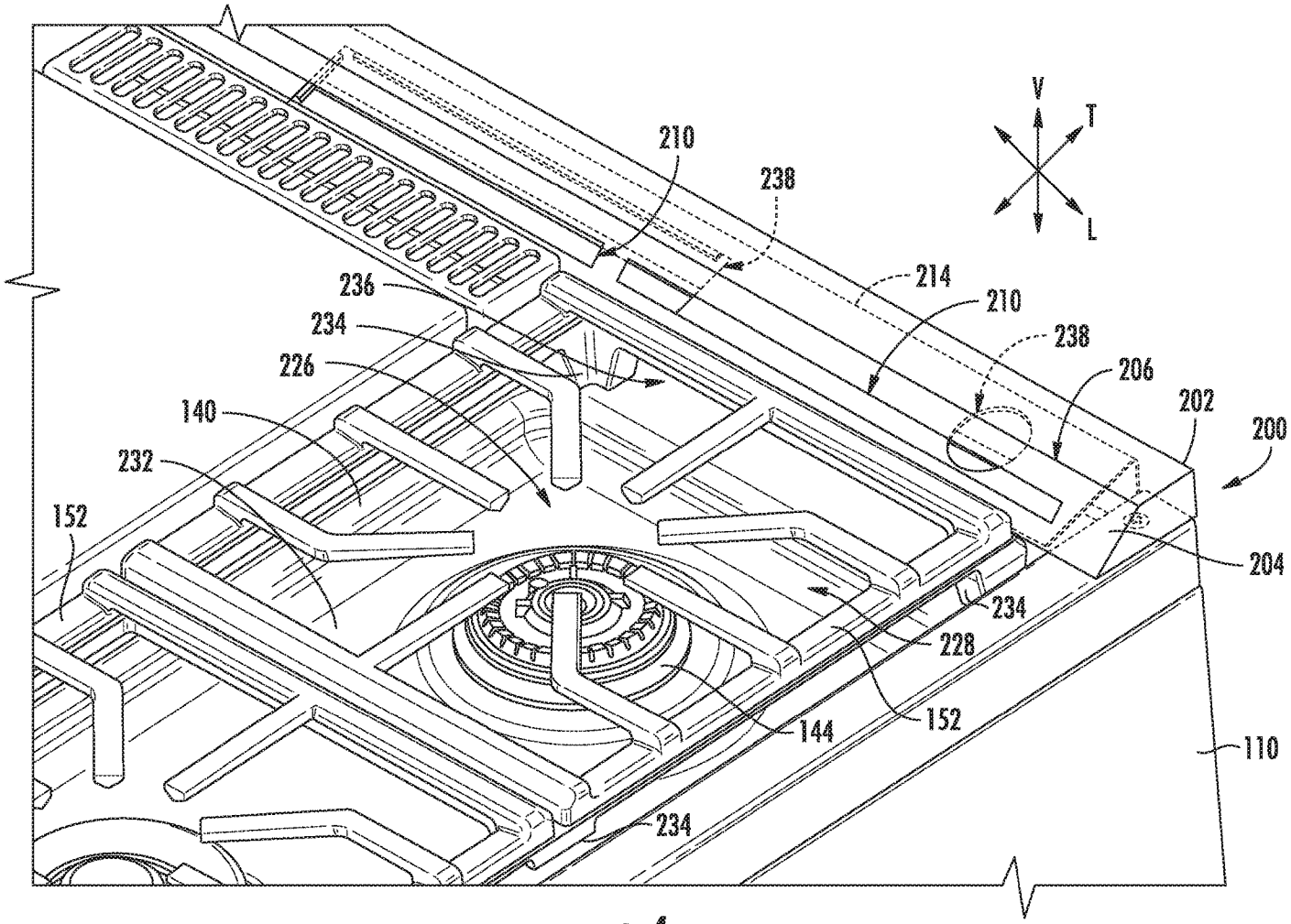
FIG. 4 provides a magnified view of a portion of the example cooking appliance of FIG. 1, including a deflector assembly.
Figure 5:
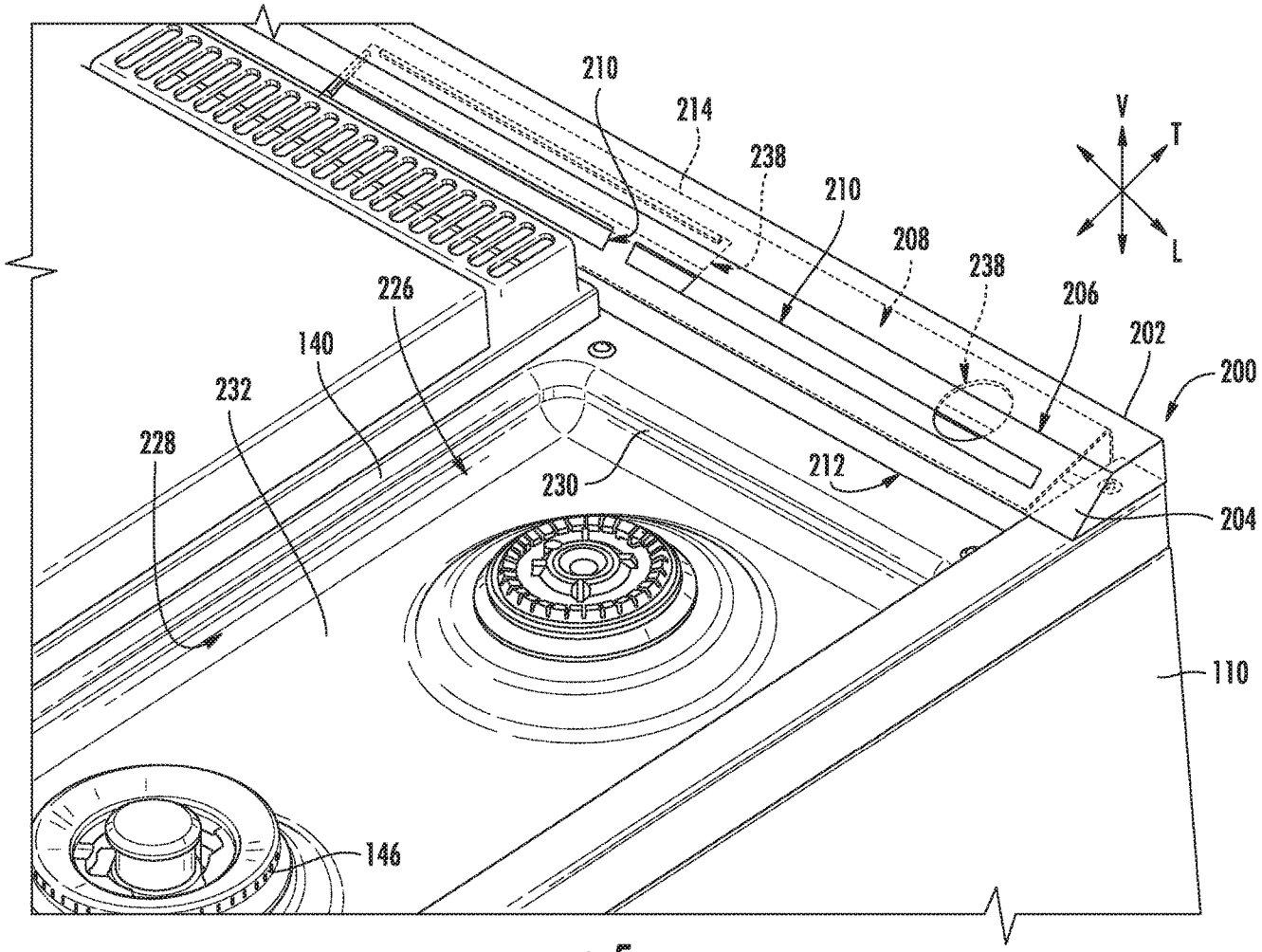
FIG. 5 provides a magnified view of a portion of the example cooking appliance of FIG. 1, wherein a cooking grate has been removed.
Figure 6:
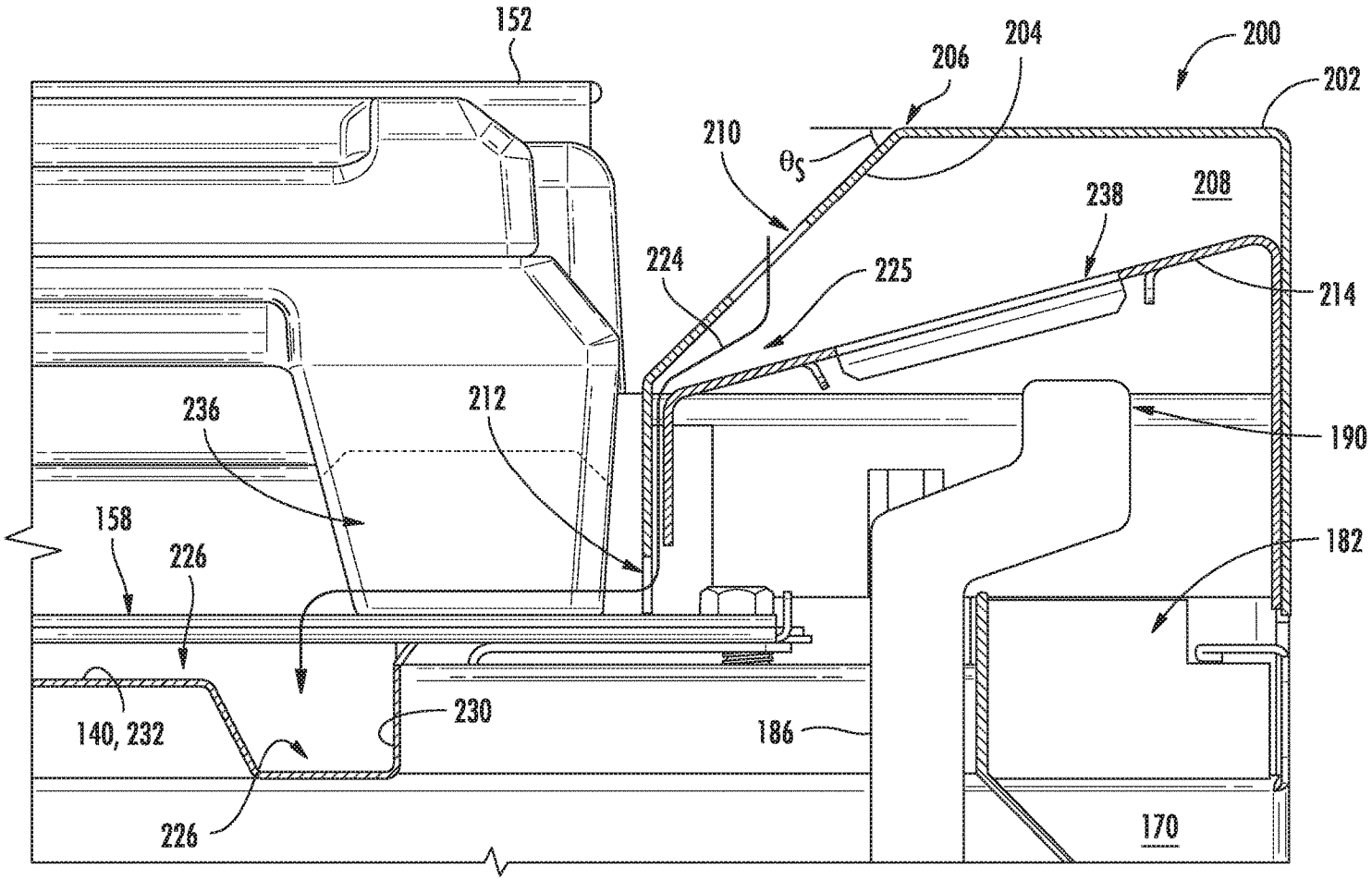
FIG. 6 provides a magnified cross-sectional view of the example deflector assembly of FIG. 4.
Figure 7:
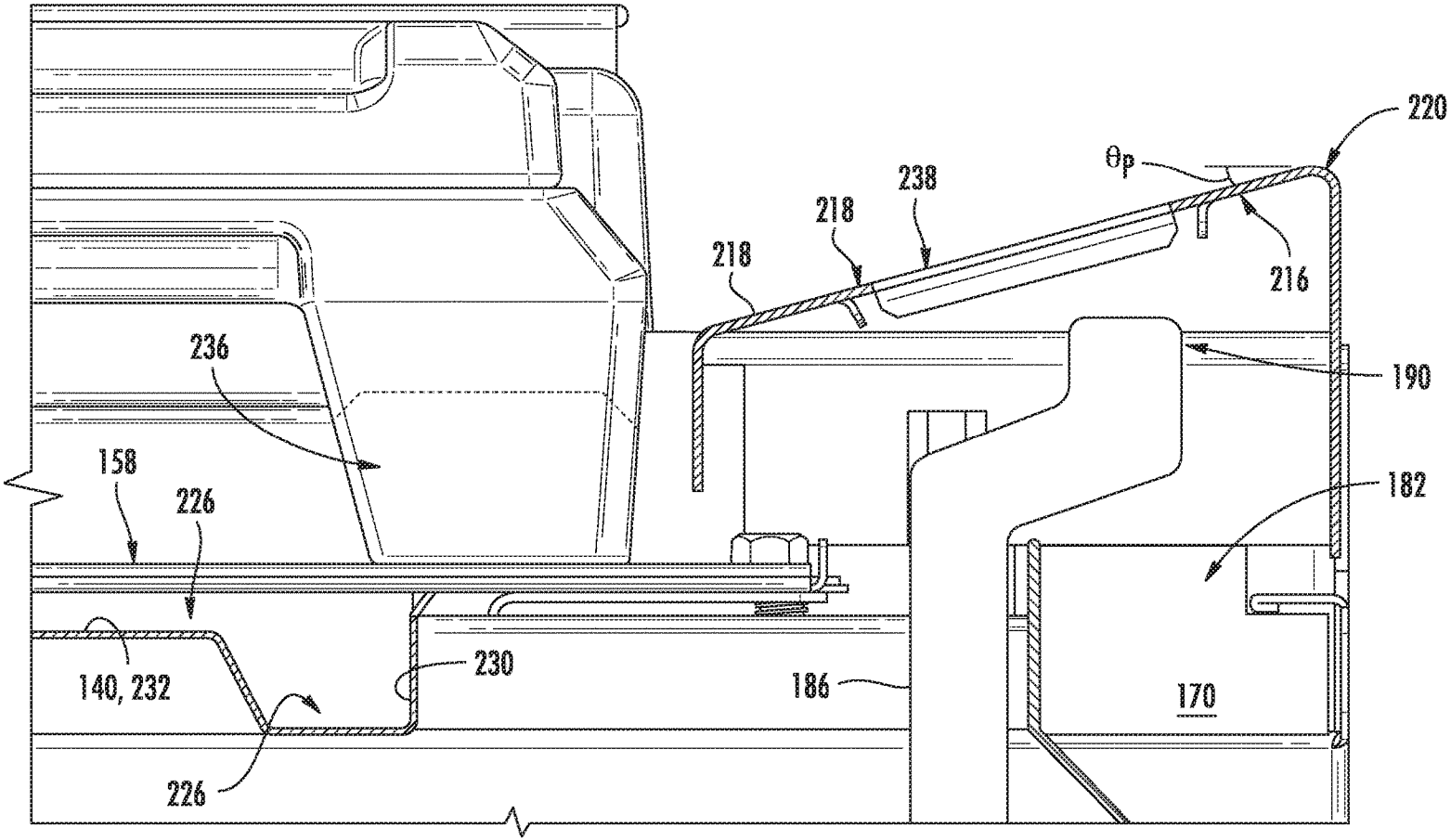
FIG. 7 provides a magnified cross-sectional view of the example deflector assembly of FIG. 4, wherein a shielding trim has been removed.

Turning now to FIGS. 2 and 3, FIG. 2 provides a side view of the example cooking appliance 100, as noted above. FIG. 3 provides a rear perspective view of cooking appliance 100. As shown, cabinet 110 defines a non-heated chamber, such as an electronics chamber 170 between the top and bottom portions 112, 113. One or more electronic components 172 may be housed within electronics chamber 170. For instance, electronic components 172 may include a control board having a microprocessor and memory unit for controlling a portion of cooking appliance 100. Optionally, electronic components 172 may form at least a portion of controller 127.

In some embodiments, electronics chamber 170 is defined within cabinet 110 at the rear portion 117. Specifically, electronics chamber 170 may be defined between cooking chamber 120 and/or 122 and a backplate 174 along the transverse direction T. Optionally, a chamber opening 178 may be defined between backplate 174 and a bottom plate 176 of cabinet 110. Additionally or alternatively, one or more chamber vents 180 may be defined through a portion of backplate 174. An exit 182 of electronics chamber 170 may be defined above opening and/or chamber vents 180. In turn, air may be permitted to travel, e.g., in the vertical direction V, into and through electronics chamber 170. Specifically, air may be permitted from chamber opening 178 and/or chamber vents 180 to exit 182. It is understood that a single unified electronics chamber 170 may be provided from the left side 114 to the right side 115 (i.e., across both chambers 120, 122), or alternatively multiple discrete electronics chambers 170 may be provided (e.g., such that a distinct electronics chamber 170 is defined laterally along the left cooking chamber 120 and right cooking chamber 122).

In certain embodiments, a ventilation blower or fan 184 is disposed or mounted within electronics chamber 170, e.g., in operable communication with a portion of controller 127. For instance, ventilation blower 184 may be mounted below electronic component(s) 172 to motivate air across electronics, for instance, to cool electronic component(s) 172. When activated, ventilation blower 184 may motivate air into chamber opening 178, e.g., from the ambient environment, and through electronics chamber 170.

In some embodiments, an exhaust duct 186 is provided to direct, e.g., exhaust air, from cooking chamber(s) 120, 122. As shown, exhaust duct 186 may extend from cooking chamber 120 or 122, e.g., from a first end 188 to a second end 190. First end 188 may be positioned at cooking chamber 120 or 122. Second end 190 may be positioned within electronics chamber 170. Specifically, second end 190 may be positioned above electronic component(s) 172 (as illustrated in FIGS. 2 and 3) and/or otherwise offset from electronic component(s) 172. During operation, exhaust air may enter exhaust duct 186 at the first end 188, travel through exhaust duct 186 toward second end 190, and exit 182 exhaust duct 186 at second end 190. Optionally, a discrete exhaust duct 186A, 186B may be provided for each cooking chamber 120, 122. A left exhaust duct 186A may extend from the left cooking chamber 120, while a right exhaust duct 186B extends from the right cooking chamber 122.

As shown in FIGS. 1 through 3, a perimeter 192 is defined at the top portion 112 of cabinet 110, e.g., along the lateral direction L and transverse direction T. A deflector assembly 200 may be provided thereon. A shielding trim 202 extends along a portion or segment of the perimeter 192 (i.e., a perimeter segment). For instance, shielding trim 202 may extend from the left side 114 to the right side 115 of cabinet 110 at the rear portion 117 of cabinet 110 and perimeter 192. Shielding trim 202 generally extends above top panel 142, including top surface 158, in the vertical direction V.

Turning now to FIGS. 4 through 7, multiple magnified views of deflector assembly 200 are provided. As illustrated, shielding trim 202 is mounted to cabinet 110. Shielding trim 202 may include an inclined face 204 that extends from a vertical maximum 206 of shielding trim 202. Specifically, inclined face 204 extends at a non-orthogonal angle $\theta_S$, e.g., in the transverse direction T, towards top panel 142. For instance, inclined face 204 may extend at an angle $\theta_S$ that is between twenty degrees) (20°) and seventy degrees (70°) relative to the transverse direction T. If the angle $\theta_S$ of inclined face 204 is defined from the vertical maximum 206 of shielding trim 202 toward the top panel 142, the angle of inclined face 204 may have a negative value [e.g., between negative twenty degrees (−20°) and negative seventy degrees (−70°)].

Shielding trim 202 generally defines a housing cavity 208. Moreover, shielding trim 202 defines spill opening 210 extending into housing cavity 208 to receive liquids or food items. As an example, in some embodiments, spill opening 210 is defined through inclined face 204, e.g., at an angle that is perpendicular to angle $\theta_S$. As liquids or food items are spilled from, e.g., a utensil (not pictured) positioned on grate 152, the items may travel through spill opening 210 and into housing cavity 208.

Shielding trim 202 may further define a drain opening 212 below spill opening 210. As shown, drain opening 212 may be in fluid communication with top panel 142 and housing cavity 208. In certain embodiments, spill opening 210 is defined between a portion of shielding trim 202 and top surface 158 of top panel 142. Liquids or food items received within housing cavity 208 may thus flow through a portion of housing cavity 208 and to top panel 142 through drain opening 212. Optionally, a plurality of drain openings 212 may be defined. In some such embodiments, a portion of shielding trim 202 rests on top panel 142, e.g., between multiple discrete drain openings 212, and maintains a vertical height between an uppermost edge of drain opening 212 and top panel 142.

In some embodiments, deflector assembly 200 includes a deflection plate 214 that is attached to cabinet 110 above electronics chamber 170. For instance, deflection plate 214 may be housed within shielding trim 202 (e.g., within housing cavity 208). As shown, deflection plate 214 includes a lower face 216 that is directed towards electronics chamber 170 and an upper face 218 that is directed away from electronics chamber 170. Lower face 216 and upper face 218 may be parallel.

When assembled, deflection plate 214 extends at a non-orthogonal angle $\theta_P$, e.g., in the transverse direction T, towards top panel 142. For instance, deflection plate 214 may extend at an angle $\theta_P$ that is between fifteen degrees (15°) and sixty degrees (60°) relative to the transverse direction T. If the angle $\theta_P$ of deflection plate 214 is defined from a vertical maximum 220 of deflection plate 214 toward the top panel 142, the angle of the deflection plate may have a negative value [e.g., between negative fifteen degrees (−15°) and negative sixty degrees (−60°)]. The angle $\theta_P$ of deflection plate 214 generally defines a spill path 224 directed to top panel 142. The region between deflection plate 214 and shielding trim 202 may be defined as a liquid passage 225. Thus, liquids or food items that enter housing cavity 208 may be directed along spill path 224 to liquid passage 225 and through spill opening 210 before being received on top panel 142.

As shown, top panel 142 may define a well 226 at one or more of burner assemblies 144, 146, 148, 150. Each well 226 may be bounded by a containment wall 230 that extends a surrounding portion of the top panel 142 and/or cabinet 110, e.g., below the perimeter 192 of cabinet 110 along the vertical direction V. Containment wall 230 may extend about one more burner assemblies (e.g., burner assemblies 144, 146, 148, 150). For instance, in certain example embodiments, such as those shown, a single well 226 may extend about two or more burners (e.g., burner assemblies 144 and 146; 148 and 150). Optionally, a recessed moat 228 may be defined within well 226, e.g., below a burner. Recessed moat 228 may extend along containment wall 230, e.g., below a plateaued portion 232 of top panel 142 on which a burner is positioned.

As shown, grate 152 may rest on a portion of top panel 142, e.g., above containment wall 230. For instance, grate 152 may include a plurality of discrete feet 234 that contact top panel 142. A flow passage 236 may be defined between each foot 234. Specifically, flow passage 236 may be defined between top panel 142 and cooking grate 152. As liquid flows from deflector assembly 200, it may pass through flow passage 236 before being received within well 226 and/or recessed moat 228. Advantageously, spills may thus being contained on top panel 142 where they may be easily cleaned or evaporated away, e.g., in response to the heat generated at a burner assembly (e.g., one of burner assemblies 144, 146, 148, 150).

One or more ventilation apertures 238 may be defined through a portion of deflection plate 214. For instance, ventilation aperture 238 may extend through deflection plate 214 from the upper face 218 to the lower face 216. Moreover, ventilation aperture 238 may extend at an angle that is perpendicular to angle $\theta_P$, e.g., to permit air through deflection plate 214. In some such embodiments, ventilation aperture 238 is in fluid communication with spill opening 210. Additionally or alternatively, ventilation aperture 238 may be in fluid communication with electronics chamber 170. In turn, ventilation aperture 238 may be in fluid communication between the exit 182 of electronics chamber 170 and spill opening 210 of shielding trim 202. Air may thus pass from electronics chamber 170 through ventilation aperture 238, and out of spill opening 210. Optionally, at least one ventilation aperture 238 may be in fluid communication with exhaust duct 186. In such embodiments, exhaust air may thus pass from the second end 190 of exhaust duct 186, through ventilation aperture 238, and out of spill opening 210.

Figure 8:
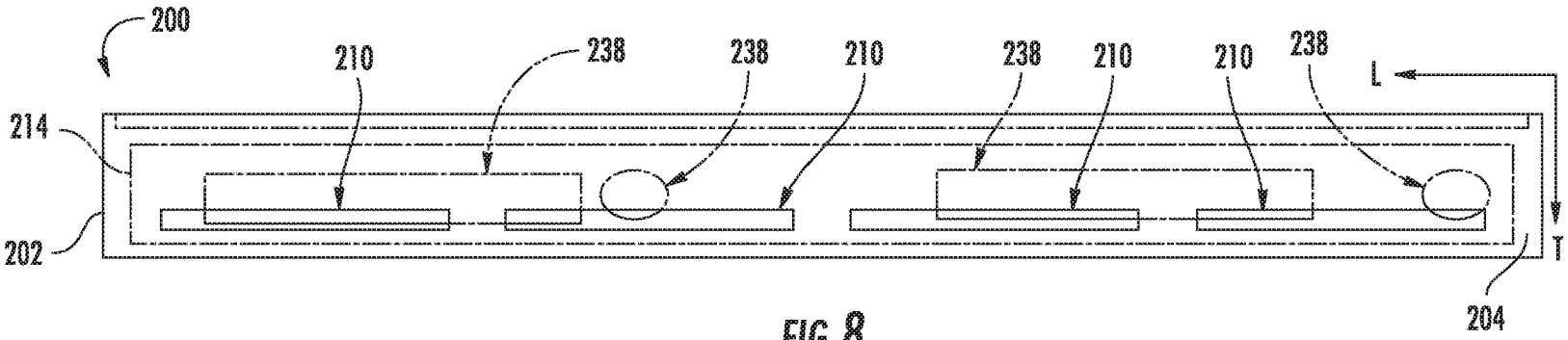
FIG. 8 provides a plan view of the example deflector assembly of FIG. 4.
Figure 9:
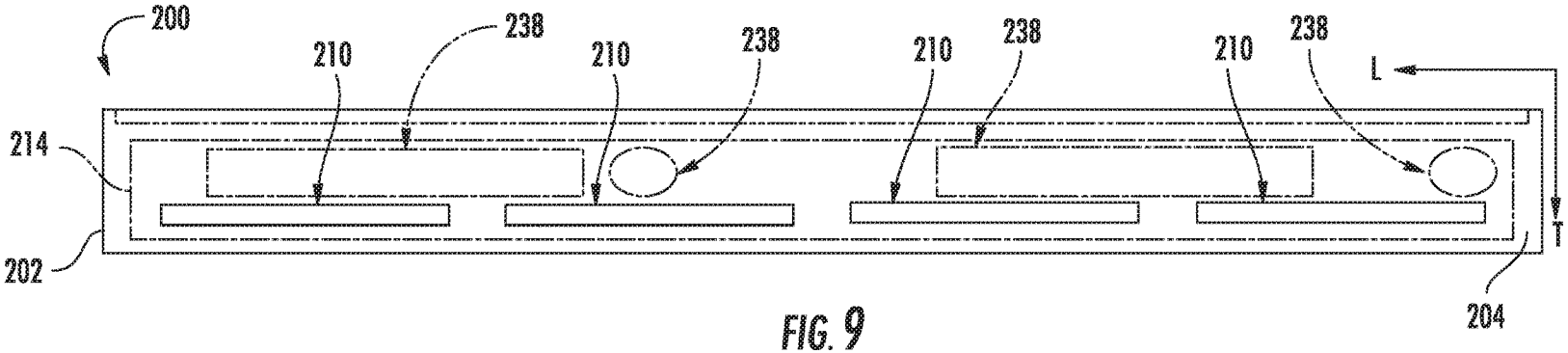
FIG. 9 provides a plan view of an alternative example deflector assembly.

Turning now to FIGS. 8 and 9, overhead plan views of two example embodiments the deflector assembly 200. As illustrated, one or more of the ventilation apertures 238 may be offset from one or more of the spill openings 210. At least a portion of each ventilation aperture 238 may be at least partially blocked by shielding trim 202. For instance, in the example embodiments of FIG. 8, each ventilation aperture 238 is partially offset from a spill opening 210 along the lateral direction L. Moreover each ventilation aperture 238 is partially offset from a spill opening 210 along the transverse direction T. Alternate embodiments may provide ventilation aperture(s) 238 and spill opening(s) 210 at unique offset positions. For instance, in the example embodiments of FIG. 9, each ventilation aperture 238 is partially offset from a spill opening 210 along the lateral direction L, while each ventilation aperture 238 is fully offset from a spill opening 210 along the transverse direction T.

Figure 10:
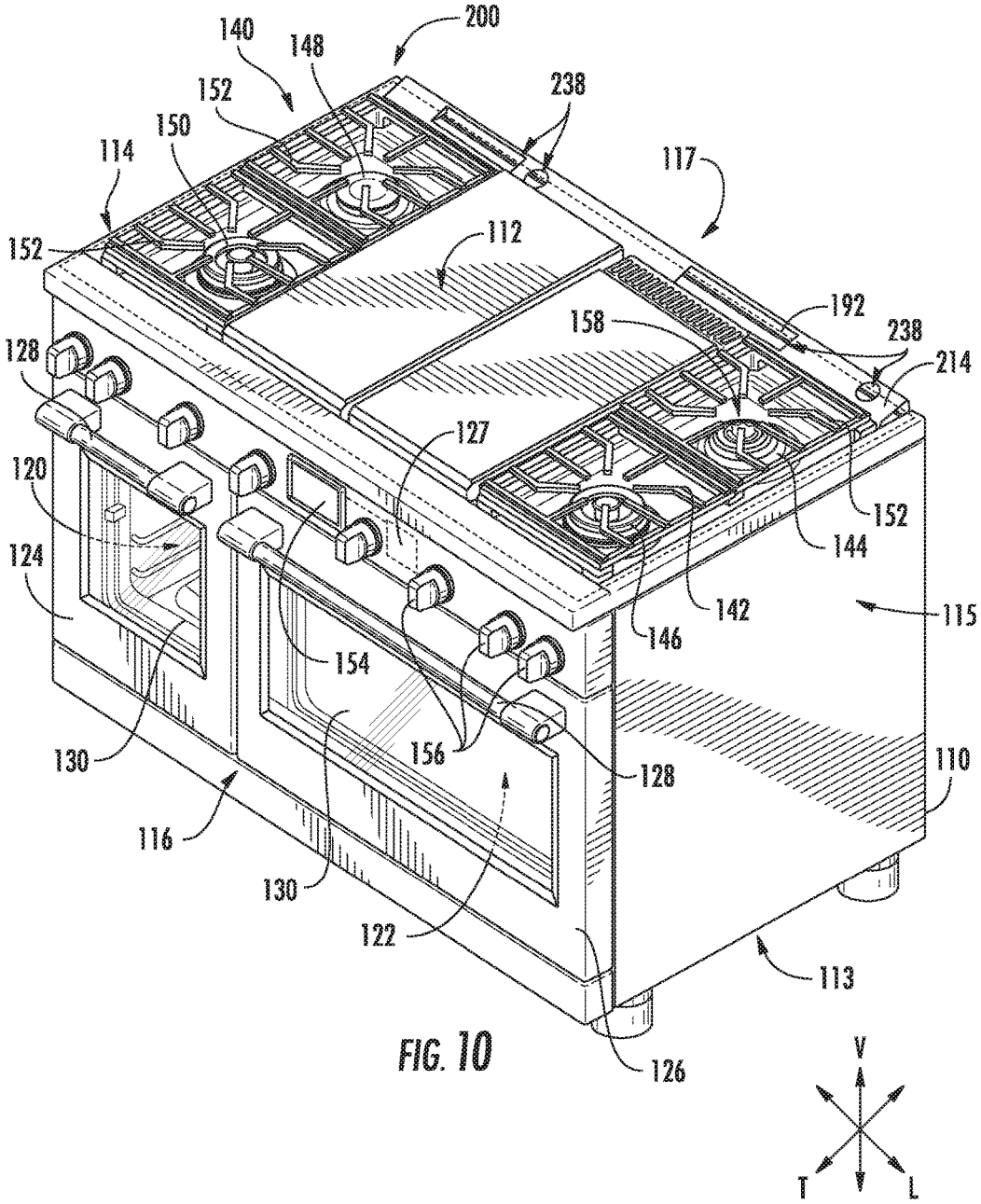
FIG. 10 provides a front perspective view of an alternative cooking appliance according to example embodiments of the present disclosure.

It should be noted that although the above embodiments described above detail the relationship between various portions of a deflector assembly 200 and cabinet 110 of an appliance 100, alternative embodiments may dispense with certain elements. For example, as illustrated in FIG. 10, optional embodiments of cooking appliance 100 may provide a deflector assembly 200 that includes a deflector plate, but is free of any shielding trim portion. Cooking appliance 100, as well as deflector assembly 200 may be otherwise identical to the embodiments described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance defining a mutually-perpendicular vertical direction, lateral direction, and transverse direction; the cooking appliance comprising:

a cabinet extending in the vertical direction from a top portion to a bottom portion, the cabinet defining a non-heated chamber between the top portion and the bottom portion;

a top panel positioned at the top portion of the cabinet;

a burner positioned on the top panel;

a deflection plate extending at a non-orthogonal angle from the top panel at a rear portion of the cabinet, the deflection plate defining a ventilation aperture above the non-heated chamber in fluid communication therewith; and a shielding trim extending along a perimeter segment of the cabinet, the shielding trim housing the deflection plate and defining a spill opening directed towards the top panel to receive a liquid above the top panel, the spill opening being fully offset from the ventilation aperture along the transverse direction, the spill opening being positioned closer to the burner than the ventilation aperture along the transverse direction to prevent the liquid received through the spill opening from being received through the ventilation aperture, wherein the deflection plate is angled towards the top panel and defines a spill path directed to the top panel, and wherein the cabinet extends along the transverse direction from a front portion to the rear portion.

2. The cooking appliance of claim 1, wherein the cabinet defines a cooking chamber, wherein the appliance further comprises an exhaust duct extending from the cooking chamber, and wherein the ventilation aperture is in fluid communication with the exhaust duct.

3. The cooking appliance of claim 1, wherein the non-heated chamber is defined at the rear portion of the cabinet.

4. The cooking appliance of claim 1, wherein the cabinet defines a chamber opening in fluid communication with the non-heated chamber at the bottom portion.

5. The cooking appliance of claim 1, wherein a ventilation blower is disposed within the non-heated chamber to motivate air therethrough.

6. The cooking appliance of claim 1, wherein the top panel defines a well below the burner to receive a liquid from the deflection plate.

7. The cooking appliance of claim 6, wherein the well includes a recessed moat extending about the burner.

8. The cooking appliance of claim 6, further comprising a cooking grate supported on the top panel over the burner, wherein a flow passage is defined between the top panel and the cooking grate to permit the flow of liquid from the deflector plate to the well.

9. A cooking appliance defining a mutually-perpendicular vertical direction, lateral direction, and transverse direction, the cooking appliance comprising:

a cabinet extending in the vertical direction from a top portion to a bottom portion, the cabinet defining a non-heated chamber between the top portion and the bottom portion;

a top panel positioned at the top portion of the cabinet;

a burner positioned on the top panel;

a shielding trim extending along a perimeter segment of the cabinet, the shielding trim defining a spill opening directed towards the top panel to receive a liquid above the top panel; and a deflection plate housed within the shielding trim, the deflection plate extending at a non-orthogonal angle relative to the transverse direction, the deflection plate defining a ventilation aperture above the non-heated chamber in fluid communication therewith, wherein a liquid passage is defined by and between the shielding trim and the deflection plate downstream from the spill opening, wherein the shielding trim further defines a drain opening downstream from the liquid passage in fluid communication with the top panel, wherein the drain opening is defined below the spill opening to direct liquids from the spill opening to the top panel, wherein the drain opening is positioned between the burner and the liquid passage along the transverse direction to direct liquids received through the spill opening to the top panel while being restricted from the ventilation aperture, and wherein the cabinet extends along the transverse direction from a front portion to a rear portion.

10. The cooking appliance of claim 9, wherein the deflection plate is angled towards the top panel and defines a spill path directed to the top panel.

11. The cooking appliance of claim 9, wherein the shielding trim includes an inclined face extending at a non-orthogonal angle towards the top panel.

12. The cooking appliance of claim 9, wherein the cabinet defines a cooking chamber, wherein the appliance further comprises an exhaust duct extending from the cooking chamber, and wherein the exhaust duct is in fluid communication with the ventilation aperture and the spill opening.

13. The cooking appliance of claim 12, wherein the ventilation aperture is offset from the spill opening.

14. The cooking appliance of claim 9, wherein the non-heated chamber is defined at the rear portion of the cabinet below the shielding trim.

15. The cooking appliance of claim 9, wherein the cabinet defines a chamber opening in fluid communication with the non-heated chamber at the bottom portion.

16. The cooking appliance of claim 9, wherein a ventilation blower is disposed within the non-heated chamber to motivate air therethrough.

17. The cooking appliance of claim 9, wherein the top panel defines a well below the burner to receive a liquid from the deflection plate.

18. The cooking appliance of claim 17, further comprising a cooking grate supported on the top panel and extending over the burner, wherein a flow passage is defined between the top panel and the cooking grate to permit the flow of liquid from the deflector to the well.

* * * * *